US006135212A

United States Patent [19]

Georgiou

[11] Patent Number: 6,135,212

[45] Date of Patent: Oct. 24, 2000

[54] HAMMERING SCREWDRIVER WITH DISENGAGABLE STRIKING MECHANISM

[75] Inventor: Yiannis Georgiou, Voerde, Germany

[73] Assignee: Rodcraft Pneumatic Tools GmbH & Co. KG, Mülheim, Germany

[21] Appl. No.: 09/333,908

[22] Filed: Jun. 16, 1999

[30] Foreign Application Priority Data

Jul. 28, 1998 [DE] Germany ..... 198 33 943

[51] Int. Cl.[7] ..... B25D 15/00

[52] U.S. Cl. ..... 173/48; 173/93; 173/93.5

[58] Field of Search ..... 173/93, 93.5, 93.6, 173/93.7, 48, 205, 104

[56] References Cited

U.S. PATENT DOCUMENTS

| | | | |
|---|---|---|---|
| 3,610,344 | 10/1971 | Schoeps et al. | 173/93.5 |
| 3,908,768 | 9/1975 | Hess | 173/93 |
| 4,313,505 | 2/1982 | Silvern . | |
| 4,817,736 | 4/1989 | Ono | 173/93 |
| 5,083,619 | 1/1992 | Giardino et al. | 173/104 |
| 5,622,230 | 4/1997 | Giardino et al. | 173/93.5 |
| 6,003,618 | 12/1999 | Wallace | 173/93.6 |

FOREIGN PATENT DOCUMENTS

| | | |
|---|---|---|
| 1 156 717 | 10/1963 | Germany . |
| 9 303 715 | 12/1993 | Germany . |

*Primary Examiner*—Scott A. Smith
*Attorney, Agent, or Firm*—James Creighton Wray; Meera P. Narasimhan

[57] ABSTRACT

A hammering screwdriver 1 for tightening and loosening screws offers the possibility of operating the rotating action alone when tightening the screws, and a rotation/hammering action when loosening the screws. This is primarily attained by the construction of the cam controller casing 2 between which and the hammering mechanism cage 6 a ball 10 is arranged. With this exclusively rotating motion, this ball 10 lies in a salient 16 below an elevation 8 on the head end 7 of the cam controller casing 2. With rotation/hammering motion, the ball 10 is moved over the track 3 to the head end 7 of the cam controller casing 7 until it reaches the elevation. Here the cam controller casing 2 moves forward in an axial direction owing to which hammering action occurs.

10 Claims, 2 Drawing Sheets

HAMMERING SCREWDRIVER WITH DISENGAGABLE STRIKING MECHANISM

BACKGROUND OF THE INVENTION

The invention concerns a hammering screwdriver with a motor which transmits a rotating motion through a shaft to a screw spindle which drives a cam controller casing surrounded by a hammering mechanism cage for controlling the hammering motion, whereby a track arranged on the front of the cam controller casing facing away from the screw spindle is situated over its entire periphery which has an elevation in the axial direction through which the cam controller casing is arranged, yielding a channel for the rotation of a ball in interplay with the opposite-lying hammering mechanism cage, and whereby the cam controller casing engages in an axially displaceable pin which compresses a spring, ensuring a return to the initial state through a sliding motion exercising the hammering action.

Hammering screwdriver devices are used as an aid in tightening and loosening screws. They have become especially indispensable for minimizing the expenditure of time and energy in numerous technical areas. In contrast to traditional pneumatic or electrical screwdriving devices, hammering screwdrivers have the advantage that, in addition to high torque, strokes are executable in an axial direction with them. Chiefly three types of striking mechanisms have prevailed, the pin stroke mechanism, the hammer stroke mechanism and the claw stroke mechanism.

At the same time, it has proved to be a great disadvantage that it has thus far not been possible to regulate the torque in connection with tightening screws, or to restrict it controllably. Thus, it occurs again and again, as a consequence of excessively high momentum stress, that the screws are too tightly drawn in. This can lead to destruction of the screws or its thread, but also to that of the material into which the screws are inserted. Especially serious problems arise within the framework of installing automobile wheels. When the screws are subsequently loosened, however, a high applicable torque is once again desirable in connection with automobiles, especially through braking torque, for which the hammering action is indispensable. A screwdriving device which instead of a combined rotation/hammering action offers only a simple rotation action often does not suffice here. When using hammering screwdrivers, damage to the rims occurs repeatedly as a consequence of high torque. The consequences of this are imbalances which can lead to the rims being unusable in extreme cases. It is in any case necessary that the operating personnel check the seat themselves with a mechanical torque wrench after installing the screws. A further disadvantage in the previously known technology lies in that a high noise stress arises when the screws are overwound as a consequence of excessively large applied torques. Moreover, destruction, possibly of the thread, which can lead to devastating consequences with automobile wheels in particular, is thereby more difficult to determine.

SUMMARY OF THE INVENTION

The objective of the invention is therefore to create a screw driving device which prevents the occurrence of uncontrolledly high torques and is sparing of material as it eliminates possible overwinding of the thread and the destruction associated therewith. The device should be operated more reliably and safely than was previously possible, and should prevent unnecessary noise stress. With the new device, it should be possible to apply significantly higher torques for loosening screws than for tightening them.

This objective is accomplished in that the cam controller casing is constructed so as to enable a fixation of the ball in connection with the tightening motion of the screw and consequently block the hammering action in connection with the rotating motion. But with the loosening motion of the screw, it is constructed so as to enable a revolution of the ball on the track or in the channel, consequently producing the hammering action with simultaneous rotation.

In this way, the hammering screwdriver device of the invention offers the advantage that the hammering mechanism is blocked when tightening the screw, thus when rotating clockwise, and only the rotation action is functioning. Consequently, the hammering screwdriver device only applies a specified torque. This may as a rule be smaller than the torque with which the screw is to be fastened in the final analysis. For the motor vehicle area, this perhaps means that not the prescribed torque of, for example, 90 to 120 Nm is applied by the machine in installing wheels, but only about 30 Nm. The remaining torque is to be applied mechanically by the operator, perhaps by use of an appropriate torque wrench. This way, damage and destruction of the rim or screws are avoided. The ball transmitting force between the cam controller casing and the hammering mechanism cage blocks the hammering action of the screw driving device due to the construction of the cam controller casing of the invention. With the loosening motion of the screw, for which basically higher torque is to be applied, the rotation action as well as the hammering action operate. The transmission of force between the cam controller casing and the hammering mechanism cage operates as in traditional hammering screwdriver devices without any disadvantages in comparison with the known state of the art.

That the rotation action alone operates in tightening while the rotation action and hammering action operate in combination in loosening screws is especially attained in that the cam controller casing has at least one elevation on its head end owing to which the track on the one side is constructed flat and evenly rising, and on the other side abruptly declining and consequently interrupting the course of the track, owing to which contact between the ball and the track, and the hammering action along with them, is interrupted for a short time. Through this basically different construction of the track on both sides of the elevation, it is assured that the ball is blocked when the screw is tightened, that is, clamped in, and is moved over a flank guaranteeing a constant rotation of the ball during loosening of the screws. The arrangement of the track is such that when the hammering screwdriver rotates counterclockwise, the cam controller casing strikes in the direction of the screw spindle and thus generates the desired hammering motion. If, on the other hand, the ball is blocked, it is not able to overcome the abruptly declining, steep break of the elevation. A motion of the cam controller casing in an axial direction is accordingly prevented. This abruptly declining break is advantageously constructed such that it is once again jumped over by the ball in connection with the opposite direction of rotation, thus when loosening the screw, whereby this process coincides with the hammering motion of the device.

In order to guarantee this blocking of the ball in connection with clockwise rotation in an especially reliable manner and at the same time to guarantee a low wear and tear construction of the cam controller casing, it is provided that the cam controller casing has a salient in the abruptly declining area of the elevation.

The invention advantageously provides that the salient corresponds in shape to the ball. owing to this interlocking of salient and ball, it is supposed to be assured, first of all, that an undesired springing up of the ball over the elevation when the screw is being tightened is avoided and the ball is firmly clamped; and second that the ball has no play which could lead to unnecessary imbalances and consequently to wear and tear. Thanks to the construction of the hammering mechanism cage lying opposite the cam controller casing, to be explained below, this rounding adapted to the ball offers a durable and in many ways tested safety in this area.

With the process of loosening the screw, it in contrast proves to be advantageous if the cam controller casing has a beveling between the flat side and the abruptly falling-off side. This also contributes (owing to its construction) to attaining an ideal travel of the ball on the entire track without the danger of wear and tear being high. of course, this beveling should not be chosen too large as otherwise a firm seat of the ball in the salient can no longer be unconditionally guaranteed.

Owing to the high stress on the ball as a link between the cam controller casing and the hammering mechanism cage, it is provided that the track allocated to the cam controller casing has a basic shape corresponding to the ball. That means that the path is preferably shaped like a trough to guarantee a secure travel of the ball. It is consequently intended that the ball is not too strongly subjected to point stress, but over as large an area as possible. With a flat construction, the danger would exist that the pressure would be too great on individual places on the ball, and consequently it would be necessary to accept unnecessary hazards or an out-of-round travel.

For good transmission of force between the pins and the cam controller casing, it is provided that the cam controller casing is allocated a corresponding collar with recesses in the pins. A good transmission of force at this point is especially important since here extremely high stresses arises in connection with the hammering action.

An optimal revolution of the ball is furthermore attained in that in the bottom of the hammering mechanism cage, at least one circular groove yielding a channel for the ball with the cam controller housing is provided which, in interplay with the cam controller casing, is constructed so as to enable fixation of the ball. This groove is situated in the part of the hammering mechanism facing the cam controller casing. These two components through their adapted shape thus form the channel for the ball. This lies with counterclockwise and clockwise rotation in each case at the other end of the groove with a greatest possible part of its surface.

To be able to regulate the magnitude of the torque, it is provided that the supply air channel of the hammering screwdriver device is allocated a relief valve. This relief valve opens in the event of excessively high pressure and lets the air flow into the discharge channel. In this way, the air fed to the motor is controlled or restricted. Consequently, a maximum torque can be selected in advance through an adjustment device. This leads to the screws being rotated quickly only to a predetermined seat with pure rotating action of the hammering screwdriver, owing to which an optimal measure in control on the tightening of the screws is realizable without the danger of destruction. As mentioned, operating personnel can subsequently adjust the definitive firm seat of the screw using a suitable wrench. Retraction of the screws is consequently ruled out.

A preferred embodiment of the invention provides that the long axis, and therewith the thrust axis of the hammering screwdriver device, is arranged parallel and below the drive axis of the pneumatic motor in the grip of the hammering screwdriver device. The parallel arrangement of the two axes presents the advantage that an unintentional turning on or off of the hammering screwdriver device can practically be ruled out. The device can therefore not be laid down in a way in which a button is unintentionally moved, since the buttons and adjusting facilities for turning the device on and off lie in protected places or in places on which the device cannot be laid down. It is especially advantageous in connection with the present invention that the device can be operated with one hand, however, because the switch can be operated with a typical hand grip.

The invention is particularly distinguished by the fact that a hammering screwdriver is created in connection with which the two functions of a rotating action and a combined rotating/hammering action are realized. When tightening screws, the device of the invention acts as a rotary screwdriver, when loosening them, it acts like a hammering screwdriver. Clear advances with respect to conservation of material and work safety are herewith attained.

Further details and advantages of the object of the invention emerge from the following description of the associated drawings in which a preferred embodiment with the details and components necessary for it is represented, wherein:

DETAILED DESCRIPTION

Figure 1:
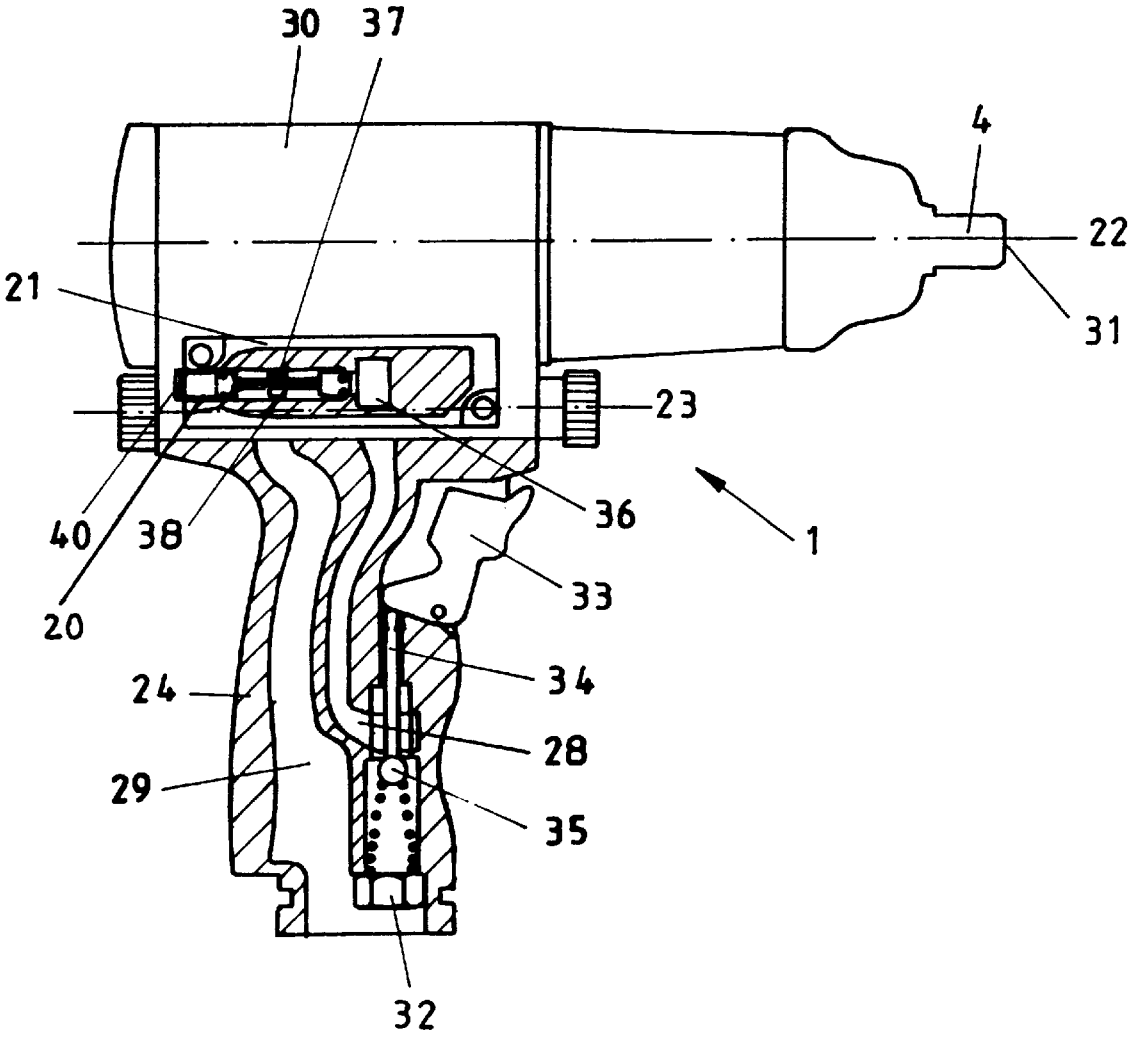
FIG. 1 Shows a hammering screwdriver, partially in section, in a lateral view, FIG. 2 Depicts a longitudinal section through a hammering screwdriver when tightening in clockwise rotation, FIG. 3 Illustrates a cross section of the hammering screwdriver device, FIG. 4 Represents the longitudinal section through a hammering screwdriver during loosening in counterclockwise rotation and FIG. 5 Presents a cam controller casing in perspective view.

FIG. 1 depicts a hammering screwdriver device 1 consisting of a housing 30 and the hand grip 24. The pneumatic motor (not described in greater detail) which drives the shaft 4 is accommodated in this housing 30. The nut (not represented here), which is adjusted with respect to the size of the respective screw, is situated on the tip of this shaft 4 which encloses this and transmits the torque of the hammering screwdriver 1 to the screw (also not represented here). Furthermore, the parallel arrangement of the drive axis to the reversing shaft is recognizable in FIG. 1. The appropriate direction of rotation, counterclockwise or clockwise rotation, is selected and set through the reversing shaft 23. In this embodiment, clockwise rotation is set by pushing the reversing shaft 23 forward in the direction of screw spindle 5 and counterclockwise rotation by pushing backward. The easy handling of the hammering screwdriver 1 of the invention becomes clear here. The operator can, for example, operate the buttons mounted on the reverse side (not represented here) of the hammering screwdriver 1 with his or her thumb.

The hammering screwdriver 1 is moreover, first of all, connected to the compressed air network through the air connection. By pressing the actuating lever 33, the valve stem 34 moves the valve ball 35 back so that air can reach into the feeder channel 28. The relief valve 21 is arranged over the feeder channel 28 and connected with this through the opening 36. The valve slide 20 closes the passage bore hole between opening 36 and discharge opening 17 by compressing the spring 38. The spring 38 can be set through an adjustment device 40. Instead of the screw represented here, however, other adjustment devices 40 are also conceivable, for example, rotary knobs or slide bars. The torque to be applied by the hammering screwdriver 1 is specified through the adjustment device, since the amount of air fed to the motor is controlled. If the pressure in the feeder channel 28 rises higher than the value which the spring 38 can accept with its compression, the relief valve 21 opens and allows the air to flow through the discharge opening 37 into the discharge channel 29.

Figure 2:
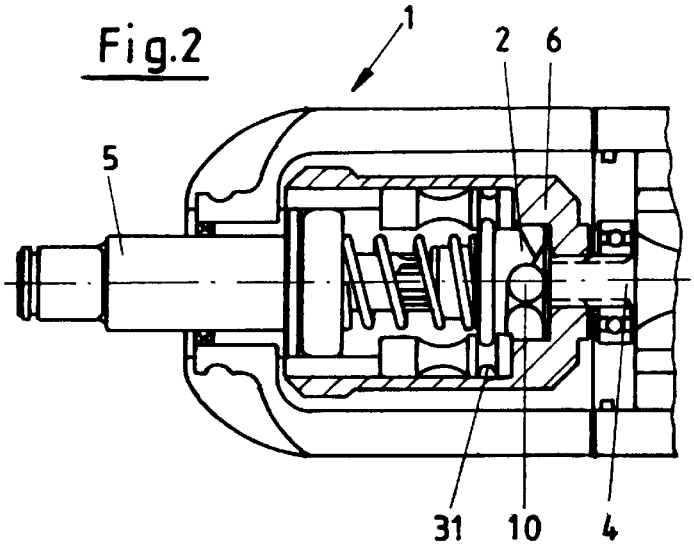

FIG. 2 illustrates the housing 30 with the screw spindle 5 situated on the tip. This is driven through shaft 4 which is enclosed by the hammering mechanism cage 6. The shaft 4 has longitudinal groovings which are constructed corresponding to the internal groovings (not represented here) of the cam controller casing 2. It is supposed to be assured through these groovings that shaft 4 and cam controller casing 2 can be slid in the framework of the hammering motion axially in relation to each other. A track 3 (not recognizable here) is situated on the head end 7 of the cam controller casing 2 for the revolution of the ball 10. The cam controller casing 2 rotates along with the shaft in the clockwise rotation of the shaft represented here. Since, however, as is apparent, the ball 10 is blocked in the channel 9, no axial displacement of this cam controller casing 2 occurs. The screw is only rotated until a specified maximum torque is reached. Hammering motions are ruled out. In the event that a hammering screwdriver device 1 of the invention is used for mounting and dismounting automobile wheels, the operating personnel must for example now apply the remaining torque necessary for firm seating of the screws with a mechanical torque wrench. This "tightening up" is in any case prescribed for checking, and thus does not represent any additional burden. This way, damage and noise stresses are avoided to a great extent.

Figure 3:
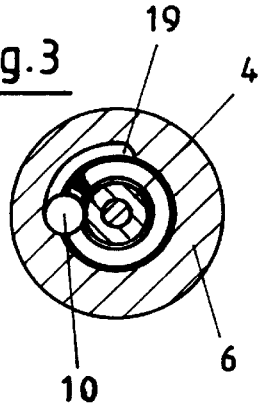

In the section representation in accordance with FIG. 3, one recognizes the ball 10 which revolves in the channel 9 formed by the hammering mechanism cage 6, shaft 4 and track 3. Here the ball 10 is in a position in which it blocks the hammering motion. The ball 10 is enclosed on one side by the cam controller casing 2 and on the other side by the hammering mechanism cage 6. This is made possible by the groove 19 which is arranged in the bottom 11 of the hammering mechanism cage 6 and which prevents a motion of the ball over the edge of the groove 19.

Figure 4:
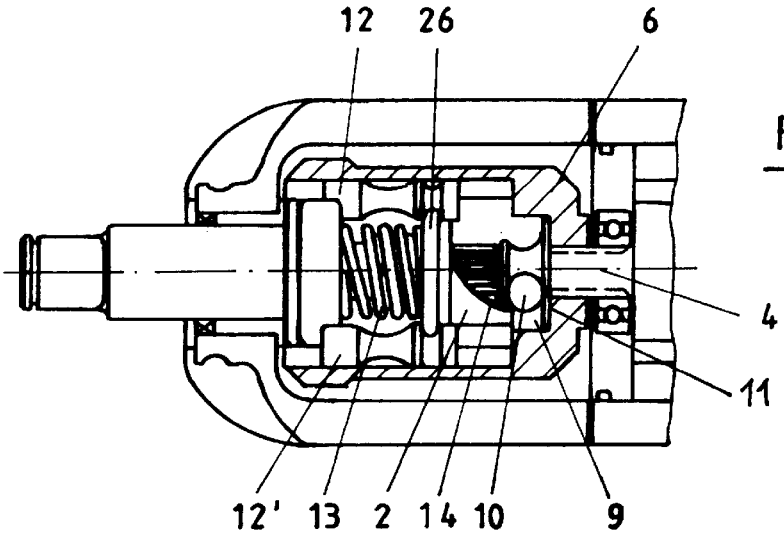

FIG. 4 shows rotation in the other direction, namely counterclockwise rotation, thus the loosening process of the screw. The ball 10 is not blocked by the declining side 15 of the cam controller casing 2, but is pressed by this with the flat side 14 against the hammering mechanism cage 6. By the advantageous rounded-off shaping of this flat side, the cam controller casing 2 is pressed in the direction of the screw spindle 5 or the nut. At the same time, the cam controller casing 2 compresses the spring 13 which after conclusion of the hammering process brings about a springing back of the cam controller casing 2 into its initial position. The cam controller casing 2 engages into recesses 31 of pins 12, 12' with the collar 26. By this shooting forward in an axial direction by the pins 12, 12', the hammering mechanism is finally pushed forward.

Figure 5:
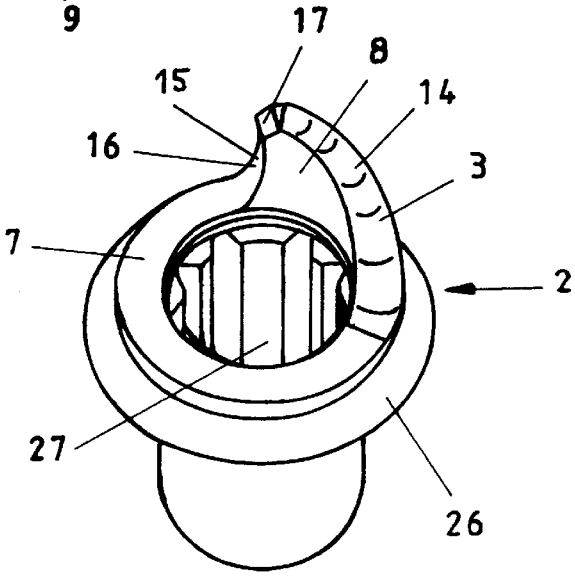

FIG. 5 shows a representation of the cam controller casing 2 in which the track 3 can be especially well recognized. This is joined force-locking with the longitudinal groovings of the shaft through the inner groovings 27 of the cam controller casing 2 so that the rotation can be optimally transmitted with free sliding in an axial direction. The collar 26 is provided for the suitable transmission of axial forces. When tightening the screw in clockwise rotation, the ball 10 is fixed in the salient 16 of the elevation 8. Since the ball 10 is held on the inside of the channel 9 by the shaft 4 and on the outside by the hammering mechanism cage 6, as well as on the head end 7 of the cam controller casing 2, likewise by the hammering mechanism cage 6, it cannot change its position. The ball 10 rotates along with the cam controller casing 2. A simultaneous axial displacement is ruled out. The salient 16 is advantageously constructed here so that the ball 10 has no play to the greatest extent possible.

With counterclockwise rotation, in the course of loosening the screw, the ball 10 is moved again about the dimension of the cam controller casing 2. For this reason, the track 3 adapted in shape to the ball 10 is provided. By this rotation, the ball 10 is pressed over the flat side 14 of the elevation 8. Only the evading motion in the direction of the screw spindle 5 remains for the cam controller casing 2. To assure a round travel of the ball 10, a beveling 17 is provided at the end of the flat side 14 of the elevation 8, through which it should be guaranteed that the high pressures occurring in this area do not lead to material damage.

All features named, even those to be gathered from the drawings alone, are viewed as essential to the invention alone and in combination.

What is claimed is:

1. Hammering screwdriver device (1) with a motor which transmits a rotary movement to a screw spindle (5) through a shaft (4) and drives a cam controller casing (2) enclosed by a hammering mechanism cage (6) to control the hammering motion, whereby a track (3) arranged around its entire periphery is situated on the head end (7) of the cam controller casing (2) facing away from the screw spindle (5) which has an elevation (8) in the axial direction, owing to which the cam controller casing (2) is arranged resulting in a channel (9) for the rotation of a ball in interplay with the opposite-lying hammering mechanism cage (6), and whereby the cam controller casing (2) engages into axially displaceable pins (12) which compress a spring (13) assuring the return to the initial state through a sliding motion executing the hammering action, characterized in that the cam controller casing (2) is constructed enabling a fixation of the ball (10) with travel in the one direction, and consequently blocking the hammering action in connection with rotation, and with travel in the other direction, enabling a revolution of the ball (10) on the track (3) or in the channel (9), and consequently producing the hammering action in connection with simultaneous rotation.

2. Hammering screw driving device according to claim 1, characterized in that the cam controller casing has on its head end at least one elevation (8) through which the track (3) on one side (14) of the elevation (8) is flat and evenly rising, and on the other side (15) is constructed as abruptly declining and consequently as interrupting the course of the track (3), owing to which the contact between ball (10) and track (3) is interrupted for a short time, the hammering action along with it.

3. Hammering screwdriver device according to claim 2, characterized in that the cam controller casing (2) has a salient (16) in the abruptly declining area of the elevation (8).

4. Hammering screwdriver device according to claim 3, characterized in that the salient (16) corresponds to the ball (10) as regards shape.

5. Hammering screwdriver device according to claim 1, characterized in that the cam controller casing (2) has a beveling (17) between the flat side (14) and the abruptly declining side (15).

6. Hammering screwdriver device according to claim 1, characterized in that the track (3) allocated to the cam controller casing (2) has a basic shape corresponding to the ball (10).

7. Hammering screwdriver device according to claim 1, characterized in that the cam controller casing (2) is allocated a collar (26) with recesses (31) corresponding to the pins (12).

8. Hammering screwdriver according to claim 1, characterized in that in the bottom (11) of the hammering mechanism cage (6), at least one circular groove (19) yielding a channel for the ball (10) with the cam controller casing (2) is provided which is constructed as enabling a fixation of the ball (10) in interplay with the cam controller casing (2).

9. Hammering screwdriver device according to claim 1, characterized in that the motor is constructed as a pneumatic motor in the feeder channel (28) of which a relief valve (21) is arranged.

10. Hammering screwdriver device according to claim 1, characterized in that the reversing shaft (23) is arranged parallel to the long axis (22) and therewith to the sliding axis of the hammering elements in the hand grip (24) or housing (30).

* * * * *